United States Patent [19]

Shimada et al.

[11] 4,031,456

[45] June 21, 1977

[54] CONSTANT-CURRENT CIRCUIT

[75] Inventors: Shunji Shimada, Kodaira; Yoshikazu Hatsukano, Hachioji; Osamu Yamashiro, Kodaira, all of Japan

[73] Assignee: Hitachi, Ltd., Japan

[22] Filed: Aug. 28, 1975

[21] Appl. No.: 608,731

[30] Foreign Application Priority Data

Sept. 4, 1974 Japan ..... 49-100916

[52] U.S. Cl. ..... 323/4; 331/186

[51] Int. Cl.[2] ..... G05F 3/08

[58] Field of Search ..... 307/296, 297, 304; 323/1, 4, 16, 22 R; 331/185, 186

[56] References Cited

UNITED STATES PATENTS

| | | | |
|---|---|---|---|
| 3,508,084 | 4/1970 | Warner | 323/22 R |
| 3,806,742 | 4/1974 | Powell | 307/297 |
| 3,815,354 | 6/1974 | Strocka et al. | 323/1 |

*Primary Examiner*—A. D. Pellinen
*Attorney, Agent, or Firm*—Craig & Antonelli

[57] ABSTRACT

A constant-current circuit has a depletion type FET and a series circuit consisting of an impedance element and an enhancement type FET connected in parallel between two terminals. The gate electrodes of the respective FET's are connected to a juncture between the impedance element and the enhancement type FET, and current which flows through the depletion type FET is set to be sufficiently larger than a current which flows through the series circuit. The voltage across the enhancement type FET is made substantially equal to a threshold voltage thereof, whereby the constant current characteristics of such constant-current circuits are checked from being dispersed.

4 Claims, 4 Drawing Figures

CONSTANT-CURRENT CIRCUIT

DETAILED DESCRIPTION OF THE INVENTION

This invention relates to a constant-current circuit, and more particularly it is devoted to a constant-current circuit which is constructed of insulated gate field-effect transistors (hereinbelow, simply termed FET's).

In general, in semiconductor integrated circuits constructed of FET's, it is common practice to fabricate the entire circuit of enhancement type FET's. However, an integrated circuit which has a excellent delay time and power factor becomes possible by applying a depletion type FET as a load. This is described in, for example, 'Denshi Zairyo (Electronic Material)', April 1971, pp. 52 - 54.

In case of employing the load element as a resistance R which determines the CR-time constant of an oscillation circuit constructed of FET's, the charging characteristic is not changed even by a fluctuation in the supply voltage and the oscillation frequency is stabilized because the load element has a constant-current characteristic.

A current I flowing through the load element, however, is represented by the following equation (1) and varies largely on account of the dispersion of the threshold voltage $V_{thD}$ being a process parameter.

$$I = \frac{1}{2} \beta V_{thD}^2 \quad (1)$$

where $\beta$ denotes the channel conductivity to 1 V of the gate voltage, and $V_{thD}$ the threshold voltage.

In the oscillation circuits employing the load elements, accordingly, the oscillation frequencies are dispersed due to the dispersion in the process, but the stabilization of the oscillation frequencies of the individual oscillation circuits is achieved against the fluctuations of the supply voltage.

This invention has been made in order to solve the above problem. It has for its object to suppess the dispersion of the constant current characteristic ascribable to the dispersion in the process, in a constant-current circuit constructed of FET's. Another object is to make improvements in the temperature characteristic simultaneously with the suppression of the dispersion of the constant-current circuit.

The fundamental construction (1) of this invention for accomplishing the object resides in a circuit wherein a depletion type FET $M_1$, and a series circuit consisting of impedance means and an enhancement type FET $M_2$ are connected between two terminals A and B and wherein gate electrodes of the respective FET's $M_1$ and $M_2$ are connected to a juncture between the impedance means and the FET $M_2$, characterized in that a current $I_1$ which flows through the FET $M_1$ is set to be sufficiently large in comparison with a current $I_2$ which flows through the series circuit, and that a voltage across the FET $m_2$ is made substantially equal to a threshold voltage of this FET $M_2$.

The construction (2) of this invention resides in the circuit of the fundamental construction (1), characterized in that the impedance means is made a depletion type FET $M_3$, a gate electrode of which is connected to the terminal B, and that the FET $M_3$ is used in a positive temperature characteristic region or the FET $M_2$ in a negative temperature characteristic region.

Hereunder this invention will be concretely explained along embodiments with reference to the drawing.

$M_1$–$M_3'$, $M_1'$–$M_3'$, $M_1''$–$M_3''$, $M_{S1}$–$M_{S3}$ are FET's, and R – R'' are resistances.

Figure 1:
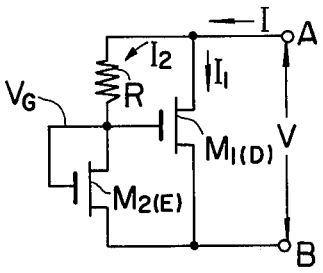
FIGS. 1 and 2 are circuit diagrams each showing an example of this invention.

FIG. 1 is a circuit diagram which shows an example of the constant-current circuit according to this invention. As illustrated in the figure, the circuit is made up of a construction to be stated below.

A depletion type FET $M_1$, and a series circuit consisting of a resistance R and an enhancement type FET $M_2$ are connected in parallel between two terminals A and B. The gate electrodes of the respective FET's $M_1$ and $M_2$ are connected to the juncture between the resistance R and the FET $M_2$.

In order that, in the circuit of the above construction, the circuit impedance as viewed from the terminals A and B may establish a constant current characteristic free from the influence of the dispersion in the manufacture of the FET's, a current $I_1$ which flows through the FET $M_1$ is made sufficiently large in comparison with a current $I_2$ which flows through the series circuit (R, $M_2$), and therewith, the value of the resistance R of the series circuit is made sufficiently large in comparison with the impedance of the FET $M_2$ so as to make a voltage $V_G$ across the FET $M_2$ substantially equal to the threshold voltage $V_{thE}$ of the FET $M_2$.

From the ensuing circuit analysis, it will be understood that the object can be accomplished in accordance with this invention of the above construction.

The current $I_1$ which flows through the FET $M_1$ is expressed by the following equation (2):

$$I_1 = \frac{1}{2} \beta_1 (V_{thD} + V_G)^2 \quad (2)$$

where $\beta_1$ denotes the channel conductivity of the FET $M_1$ to 1 V of the gate voltage, and $V_{thD}$ the threshold voltage of the FET $M_1$.

On the other hand, the current $I_2$ which flows through the series circuit (R, $M_2$) is expressed by the following equation (3):

$$I_2 = \frac{V - V_G}{R} = \frac{1}{2} \beta_2 (V_G - V_{thE})^2 \quad (3)$$

where $\beta_2$ denotes the channel conductivity of the FET $M_2$ to 1 V of the gate voltage, and $V_{thE}$ the threshold voltage of the FET $M_2$.

From Eq. (3), the voltage $V_G$ is evaluated as the following equation (4):

$$V_G = V_{thE} - \frac{2}{R\beta_2} + \sqrt{\frac{1}{R\beta_2}\left(\frac{4V_{thE}}{R\beta_2} + \frac{4}{R\beta_2} + V\right)} \quad (4)$$

If $R\beta_2 >> 1$, $V_G \approx V_{thE}$ is obtained from Eq. (4). This signifies that the voltage $V_G$ across the FET $M_2$ can be made substantially equal to the threshold voltage $V_{thE}$ of this FET $M_2$ by rendering the value of the resistance R large.

This, Eq. (2) is represented as the following Eq. (5):

$$I_1 = \frac{1}{2}\beta_1 (V_{thD} + V_{thE})^2 \quad (5)$$

Further, a current I which flows between the terminals A and B is expressed by $I_1 + I_2$. Since $I_1 >> I_2$, the current I becomes substantially equal to the current $I_1$ and is therefore given by the following Eq. (6):

$$I = \frac{1}{2}\beta_1 (V_{thD} + V_{thE})^2 \quad (6)$$

For the above reason, the current I flowing between the terminals A and B is a constant current independent of a voltage V applied therebetween and results in forming the constant-current circuit.

$(V_{thD} + V_{thE})$ in Eq. (6) is a value which is determined by the quantity of ion implantation in the process of manufacturing the integrated circuit. Even when $V_{thD}$ and $V_{thE}$ have dispersions in the manufacture, the dispersions occur complementarily, and the fluctuations of their sum $(V_{thD} + V_{thE})$ can be made small. Also for the dispersion in the process, accordingly, the current value can be prevented from dispersing.

A fluctuation with respect to the temperature of the circuit is represented by the following equation (7):

$$\frac{\alpha I}{\alpha T} = \frac{1}{2}(V_{thD} + V_G)^2 \frac{\alpha \beta_1}{\alpha T} + \beta_1 (V_{thD} + V_G) \frac{\alpha (V_{thD} + V_G)}{\alpha T} \quad (7)$$

Here, when the temperature T becomes high, $$\frac{\alpha \beta_1}{\alpha T}$$

becomes negative because the value of $\beta_1$ decreases, while $$\frac{\alpha (V_{thD} + V_G)}{\alpha T}$$

becomes substantially zero. Therefore, the temperature characteristic becomes somewhat large.

Figure 2:
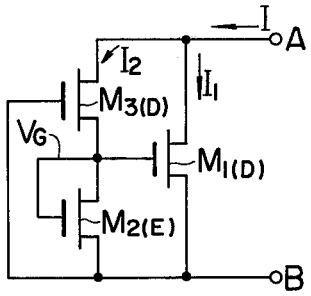

In this respect, the resistance R is replaced with a depletion type FET $M_3$ and its gate electrode is connected to the terminal B as shown in FIG. 2, and the FET $M_3$ is used in the positive temperature characteristic region of the FET $M_2$ is used in the negative temperature characteristic region, whereby the temperature-dependency can be improved over the circuit of FIG. 1.

Figure 4:
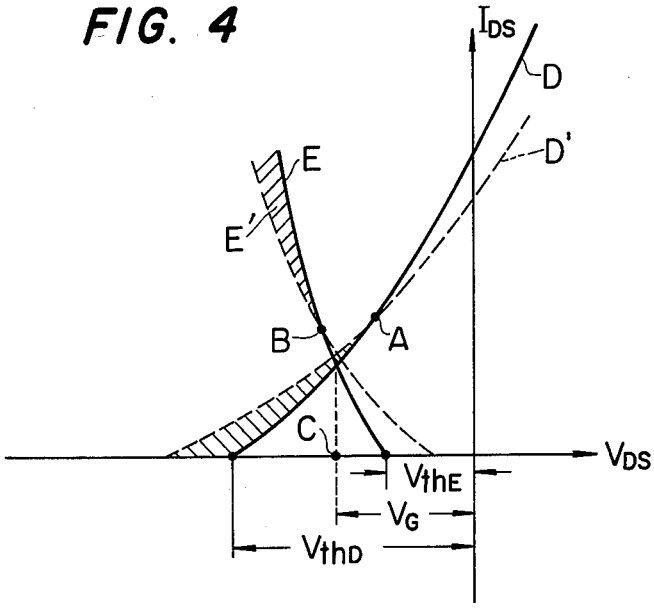
FIG. 4 is a diagram of the $V_{DS} - I_{DS}$ characteristic curves of FET's $M_2$ and $M_3$.

This will become apparent from the ensuing explanation. FIG. 4 illustrates an example of the $V_{DS}$ –$I_{DS}$ characteristic diagram of the FET's $M_2$ and $M_3$. In the diagram, curves D and E in solid lines are the characteristic curves of the FET's $M_3$ and $M_2$ at the normal temperature, respectively, while curves D' and E' shown by broken lines are the characteristic curves of the FET's $M_3$ and $M_2$ in the case where the temperature is made high, respectively. Points A and B are those at which the temperature-dependencies of the respective FET's $M_3$ and $M_2$ are zero. In the FET $M_3$ a region to the left of the point A is the positive temperature characteristic region, while in the FET $M_2$ a region to the left of the point B is the negative temperature characteristic region.

Figure 3:
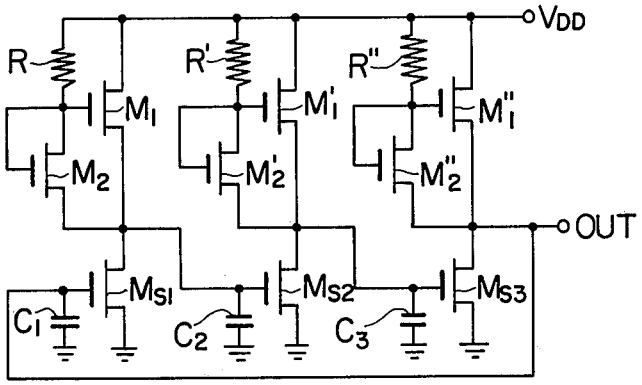
FIG. 3 is a circuit diagram showing an example in the case where this invention is applied to an oscillation circuit.

By using the constant-current circuit with the FET $M_3$ lying in the positive temperature characteristic region as set forth above, the operating point C of the series circuit ($M_2$, $M_3$) is shifted leftwards with the rise of the temperature. This acts in the direction of increasing the voltage $V_G$ which is impressed on the gate of the FET $M_1$. By raising the gate voltage $V_G$, it is inhibited that the current $I_1$ flowing through the FET $M_1$ tends to diminish due to the decrease of the channel conductivity $\beta_1$. In Eq. (7), the former term $$\frac{\alpha \beta_1}{\alpha T}$$

becomes negative, but the latter term $$\frac{\alpha (V_{thD} + V_G)}{\alpha T}$$

can be made positive in the operating region as stated above, so that the temperature characteristic can be improved.

Where the constant-current circuit according to this invention as described above is adopted as the constant-current load of an oscillation circuit as illustrated in FIG. 3, the suppression of the dispersion of the oscillation frequency and the stabilization of the oscillation frequency are achieved.

This invention is not restricted to the case of the use as such constant-current load of the oscillation circuit, but it can be generally and extensively utilized as the constant-current circuit. It will be readily understood that the resistance R may be any impedance means.

What is claimed is:

1. A constant-current circuit wherein a depletion type FET $M_1$, and a series circuit consisting of impedance means and an enhancement type FET $M_2$ are connected between two terminals A and B and wherein gate electrodes of the respective FET's $M_1$ and $M_2$ are connected to a juncture between said impedance means and said FET $M_2$, characterized in that a current $I_1$ which flows through said FET $M_1$ is set to be sufficiently large in comparison with a current $I_2$ which flows through said series circuit, and that a voltage across said FET $M_2$ is made substantially equal to a threshold voltage of this FET $M_2$.

2. The constant-current circuit as defined in claim 1, characterized in that said impedance means is made a depletion type FET $M_3$, a gate electrode of which is connected to said terminal B, and that said FET $M_3$ is used in a positive temperature characteristic region or said FET $M_2$ in a negative temperature characteristic region.

3. In an oscillator circuit comprising a plurality of n inverter stages connected in cascade where n is an odd integer greater than 1, the output of the $n^{th}$ stage being fed back to the input of the $n$-$2^{th}$ stage, and each stage including a driver field effect transistor and a storage element connected thereto, and a load connected to said driver transistor, the improvement wherein said load comprises:

a first terminal to which a first source of potential is supplied, a second terminal connected to said driver transistor, a first field effect transistor, of the depletion type, having its source and drain electrodes connected to said first and second terminals, and a series circuit of an impedance and a second field effect transistor, of the enhancement type, connected between said first and second terminals, the gate electrodes of said first and second transistors being connected in common to the juncture of said impedance and said second field effect transistor, and wherein the relationship between the current $I_1$ flowing from said first terminal to said second terminal through said first transistor and the current $I_2$ flowing from said first terminal to said second terminal through said series circuit is $I_1 >> I_2$, and the voltage across said second transistor is made substantially equal to the gate threshold voltage of said second transistor.

4. The improvement according to claim 3, wherein said impedance is a third field effect transistor, of the depletion type, the gate electrode of which is connected to said second terminal, and wherein said third transistor operates in its positive temperature characteristic region or said second field effect transistor operates in its negative temperature characteristic region.

* * * * *